US008519313B2

(12) United States Patent
Geswender et al.

(10) Patent No.: US 8,519,313 B2
(45) Date of Patent: Aug. 27, 2013

(54) PROJECTILE NAVIGATION ENHANCEMENT METHOD

(75) Inventors: Chris E. Geswender, Green Valley, AZ (US); Paul Vesty, Tuscon, AZ (US); Charles Scarborough, Pensacola, FL (US)

(73) Assignee: Raytheon Company, Waltham, MA (US)

( * ) Notice: Subject to any disclaimer, the term of this patent is extended or adjusted under 35 U.S.C. 154(b) by 374 days.

(21) Appl. No.: 12/325,352

(22) Filed: Dec. 1, 2008

(65) Prior Publication Data

US 2010/0133374 A1 Jun. 3, 2010

(51) Int. Cl.

| | |
|---|---|
| ***F41G 7/36*** | (2006.01) |
| ***G01C 21/16*** | (2006.01) |
| *F41G 7/00* | (2006.01) |
| *G01C 21/00* | (2006.01) |

(52) U.S. Cl.

USPC ..... 244/3.2; 244/3.1; 244/3.15; 701/400; 701/408; 701/500; 701/505; 702/127; 702/150; 702/151; 702/152; 702/153

(58) Field of Classification Search

USPC ..... 244/3.1–3.3, 158.1, 164, 169; 89/1.11; 102/382, 384, 473, 501; 701/1–18, 200, 701/207, 220, 221, 300, 301, 400, 408, 500–512; 342/357.01, 357.06, 357.14; 345/156, 179; 73/488, 497, 504.02, 504.03, 504.04; 702/85, 702/88, 96, 104, 127, 141, 142, 145, 150–154

See application file for complete search history.

(56) References Cited

U.S. PATENT DOCUMENTS

| | | | | |
|---|---|---|---|---|
| 3,270,983 | A * | 9/1966 | Adams et al. | 244/169 |
| 4,328,938 | A | 5/1982 | Reisman et al. | |
| 5,020,745 | A * | 6/1991 | Stetson, Jr. | 244/3.2 |
| 6,208,936 | B1 * | 3/2001 | Minor et al. | 701/220 |
| 6,456,939 | B1 * | 9/2002 | McCall et al. | 701/220 |
| 6,459,990 | B1 * | 10/2002 | McCall et al. | 701/220 |
| 6,473,713 | B1 * | 10/2002 | McCall et al. | 702/141 |
| 6,480,152 | B2 * | 11/2002 | Lin et al. | 342/357.14 |
| 6,494,093 | B2 * | 12/2002 | McCall et al. | 73/497 |
| 6,498,996 | B1 * | 12/2002 | Vallot | 702/104 |
| 6,516,283 | B2 * | 2/2003 | McCall et al. | 702/141 |
| 6,522,992 | B1 * | 2/2003 | McCall et al. | 702/141 |
| 6,651,027 | B2 * | 11/2003 | McCall et al. | 702/141 |
| 6,671,648 | B2 * | 12/2003 | McCall et al. | 702/141 |
| 6,697,758 | B2 * | 2/2004 | McCall et al. | 702/141 |

(Continued)

FOREIGN PATENT DOCUMENTS

EP 0359637 A1 * 3/1990

*Primary Examiner* — Bernarr Gregory

(74) *Attorney, Agent, or Firm* — Renner, Otto, Boisselle & Sklar, LLP

(57) ABSTRACT

A projectile, such as a missile, rolls during at least a portion of its flight, while retaining its roll reference to enable navigation during the rolling period of flight. The roll reference may be retained by using a sensor, such as magnetometer, to periodically check and correct the roll reference. Alternatively or in addition the missile may alternate roll directions, for example varying roll rate in a substantially sinusoidal function. By rolling the missile inaccuracies in an inertial measurement unit (IMU) of the missile may be ameliorated by being to a large extent canceled out by the changes in orientation of the missile as the missile rolls. This enables use of IMUs with lower accuracy than would otherwise be required to obtain accurate flight. Thus accurate flight may be accomplished with less costly IMUs, without sacrificing the ability to navigate.

18 Claims, 8 Drawing Sheets

(56) References Cited

U.S. PATENT DOCUMENTS

| | | | | |
|---|---|---|---|---|
| 6,725,719 | B2 * | 4/2004 | Cardarelli | 73/504.04 |
| 6,795,772 | B2 * | 9/2004 | Lin et al. | 701/301 |
| 6,826,478 | B2 * | 11/2004 | Riewe et al. | 701/220 |
| 6,848,648 | B2 * | 2/2005 | Klestadt et al. | 244/3.23 |
| 7,066,004 | B1 * | 6/2006 | Kohler et al. | 702/88 |
| 7,212,944 | B1 * | 5/2007 | Kohler et al. | 702/145 |
| 7,239,975 | B2 * | 7/2007 | Coleman et al. | 702/153 |
| 7,421,343 | B2 * | 9/2008 | Hawkinson | 701/220 |
| 7,508,384 | B2 * | 3/2009 | Zhang et al. | 345/179 |
| 2012/0138729 | A1 * | 6/2012 | Hindman et al. | 244/3.21 |

* cited by examiner

PROJECTILE NAVIGATION ENHANCEMENT METHOD

BACKGROUND OF THE INVENTION

1.Field of the Invention

The invention is in the field of missile and projection navigation methods and systems.

2.Description of the Related Art

Microelectromechanical system (MEMS) inertial measurement units (IMUs) are very robust for handling large accelerations, such as those associated with gun firings. However MEMS IMUs have generally low accuracy relative to precision IMUs. It will be appreciated that it would be desirable for improvements to be made in such IMUs.

SUMMARY OF THE INVENTION

According to an aspect of the invention, a missile or other projectile rolls to even out or ameliorate errors in an inertial measurement unit (IMU).

According to another aspect of the invention, a missile or other projectile has a magnetometer to allow it to keep its roll reference even when the missile or other projectile rolls.

According to yet another aspect of the invention, a missile or other projectile rolls back and forth in flight. The rocking rolling may be done following a substantially sinusoidal function, or other periodic function, or roll rate versus time.

According to still another aspect of the invention, a method of flight control of a projectile includes the steps of: providing the projectile with a microelectromechanical system (MEMS) inertial measurement unit (IMU); and reducing trajectory errors by rolling the projectile while maintaining a roll reference in the MEMS IMU, wherein the rolling evens out at least some inaccuracies of the MEMS IMU.

According to a further aspect of the invention, a method of flight control of a projectile includes: during flight of the projectile, alternately rolling the missile periodically in opposite directions.

According to a still further aspect of the invention, a method of operating a projectile includes: providing the projectile with a microelectromechanical system (MEMS) inertial measurement unit (IMU) compatible with accelerations associated with launching the projectile from a gun; and maneuvering the projectile during flight to reduce the effect of inaccuracies of the MEMS IMU.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

In the annexed drawings, which are not necessarily to scale.

DETAILED DESCRIPTION

A projectile, such as a missile, rolls during at least a portion of its flight, while retaining its roll reference to enable navigation during the rolling period of flight. The roll reference may be retained (updated and/or corrected) by using a sensor, such as magnetometer, to periodically check and correct the roll reference. Alternatively or in addition the missile may alternate roll directions, for example varying roll rate in a substantially sinusoidal function. By rolling the missile inaccuracies in an inertial measurement unit (IMU) of the missile may be ameliorated by being to a large extent canceled out by the changes in orientation of the missile as the missile rolls. This enables use of IMUs with lower accuracy than would otherwise be required to obtain accurate flight. Thus accurate flight may be accomplished with less costly IMUs, without sacrificing the ability to navigate.

Figure 1:
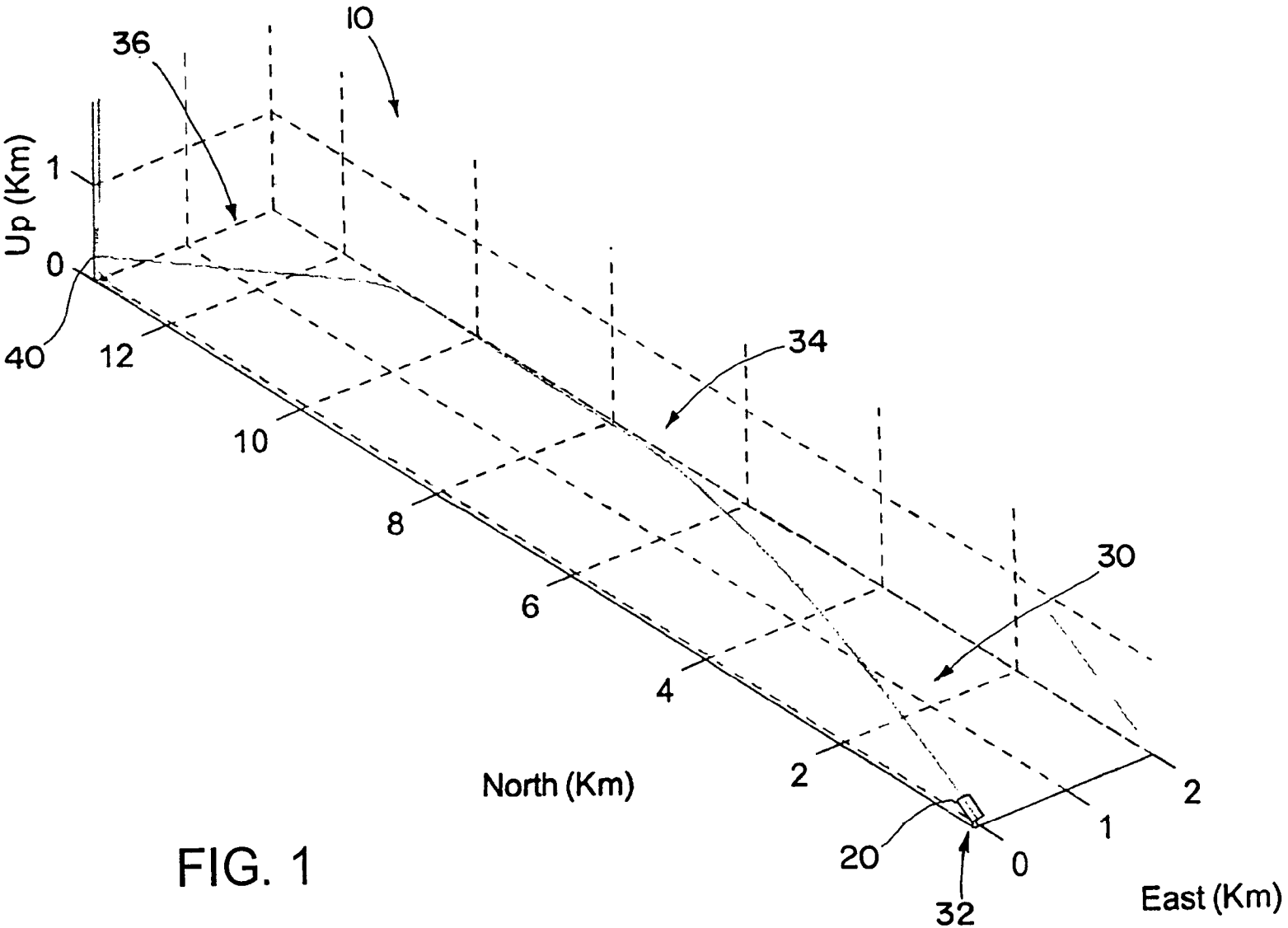
FIG. 1 is representation of a sample flight trajectory followed by a projectile in accordance with an embodiment of the present invention.

FIG. 1 shows an example ideal flight trajectory 10 for a missile or other projectile 20, a flight trajectory that will be used herein to demonstrate one problem addressed by the present invention, and the effectiveness of the various solutions and improvements presented herein. The flight trajectory 10 includes a ballistic climb 30 from a launch point 32, middle altitude hold phase 34, and a ballistic dive 36 to a desired impact point 40. The missile 20 is navigatable throughout its flight, particularly during the altitude hold phase 34 and the ballistic dive 36. To that end the missile 20 may have control surfaces, such as canards, that are used to selectively guide the missile 20. The canards and/or other control surfaces may deploy during the flight of the missile 20, for example at the beginning of the middle phase 34 of the flight trajectory 10.

Figure 2:
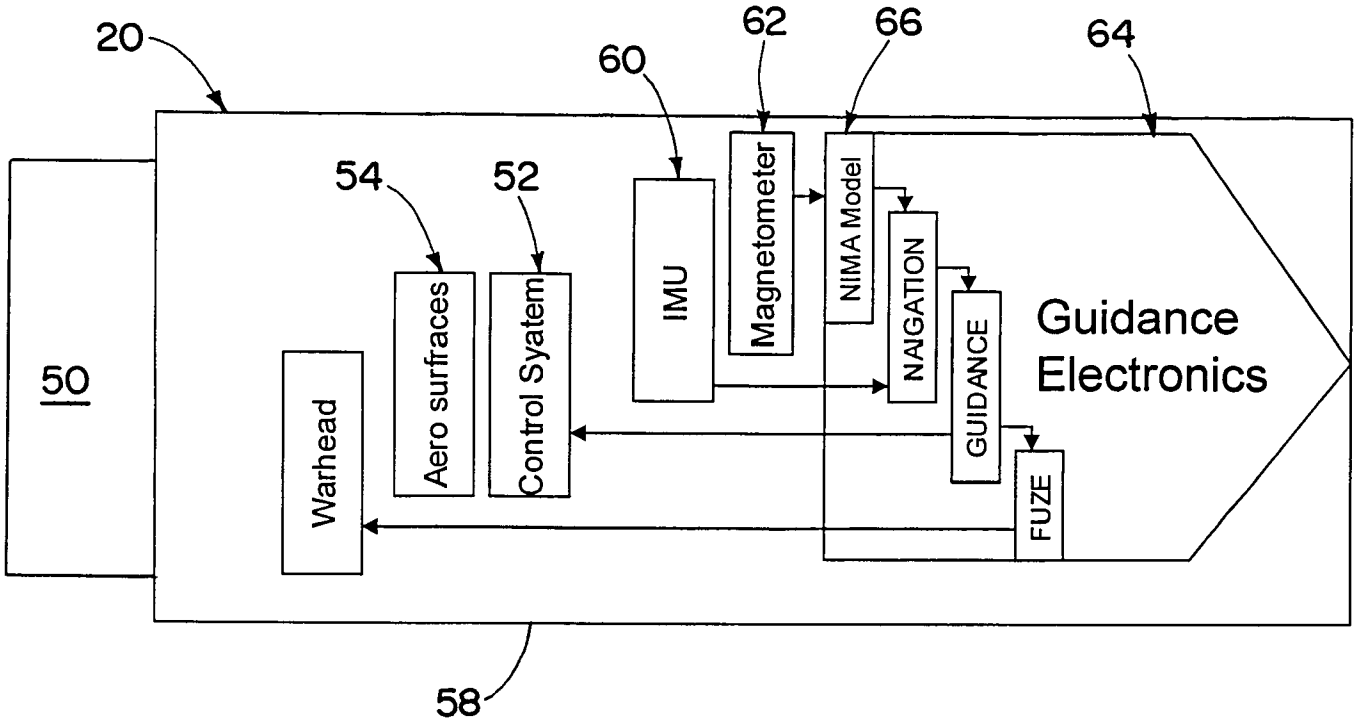
FIG. 2 is a schematic representation of a missile or other projectile suitable for carrying out an embodiment in accordance with the present invention.

FIG. 2 schematically represents various aspects of the missile 20. The missile has a thrust system 50 for providing thrust to initially accelerate the missile 20, and to continue to move the missile forward. In addition the thrust system 50 may be used to redirect the trajectory of the missile 20, such as by use of vectored thrust.

A control system 52 is used to control flight of the missile, such as by controlling the positioning and movement of control surfaces 54, such as canards or part or all of other surfaces (fins, wings, flaps, ailerons, rudders, flaperons, etc.) protruding or emerging from a fuselage 58 of the missile 20. Alternatively or in addition the control system 52 may control the thrust system 50 to aid in controlling trajectory or other navigation aspects of the missile flight. It will be appreciated that the control system 52 may be or may include a computer and other suitable components.

The control system 52 receives input from an inertial measurement unit (IMU) 60 of the missile 20. The IMU 60 detects the current rate of acceleration of the missile 20, as well as changes in rotational attributes of the missile 20, including pitch, roll, and yaw. This data is then fed into the guidance electronics computer 64, which calculates the current position of the missile 20 based on the navigation data and prior information on missile position. In essence, the control system 52 updates position of the missile 20 based on information received from the IMU 60. The magnetometer 62 may be used to help determine the initial position for initializing the IMU 60 by taking the magnetometer outputs and comparing to a magnetic flux model 66, such as a magnetic flux map available from the National Imagery and Mapping Agency (NIMA).

One potential difficulty in this arrangement is that inertial measurement units have a certain error in the data they produce. It will be recognized that there is an inaccuracy that is inherent in making any sort of measurement of any quantifiable physical parameter. The acceleration measurements and rotation measurements made by an IMU are certainly no exception. Errors in IMU measurements may be a result of inaccuracies inherent in the accelerometers used to measure accelerations, and in the gyroscopes used to determine rotation of the missile. As would be expected, greater accuracy comes at a price—more accurate IMUs cost more than less accurate IMUs.

Accuracy of IMUs is expressed in terms of both acceleration bias (units of mg) and gyroscope bias (units of degrees/hour). The latter is an expression of the maximum degrees of error an IMU accumulates in an hour of operation, to a certain level of confidence. The higher the number of degrees/hour the IMU is rated at, the less accurate that the IMU is. As may be expected, more accurate IMUs (IMUs with lower degree/hour ratings) are more expensive than less accurate IMUs.

Figure 3:
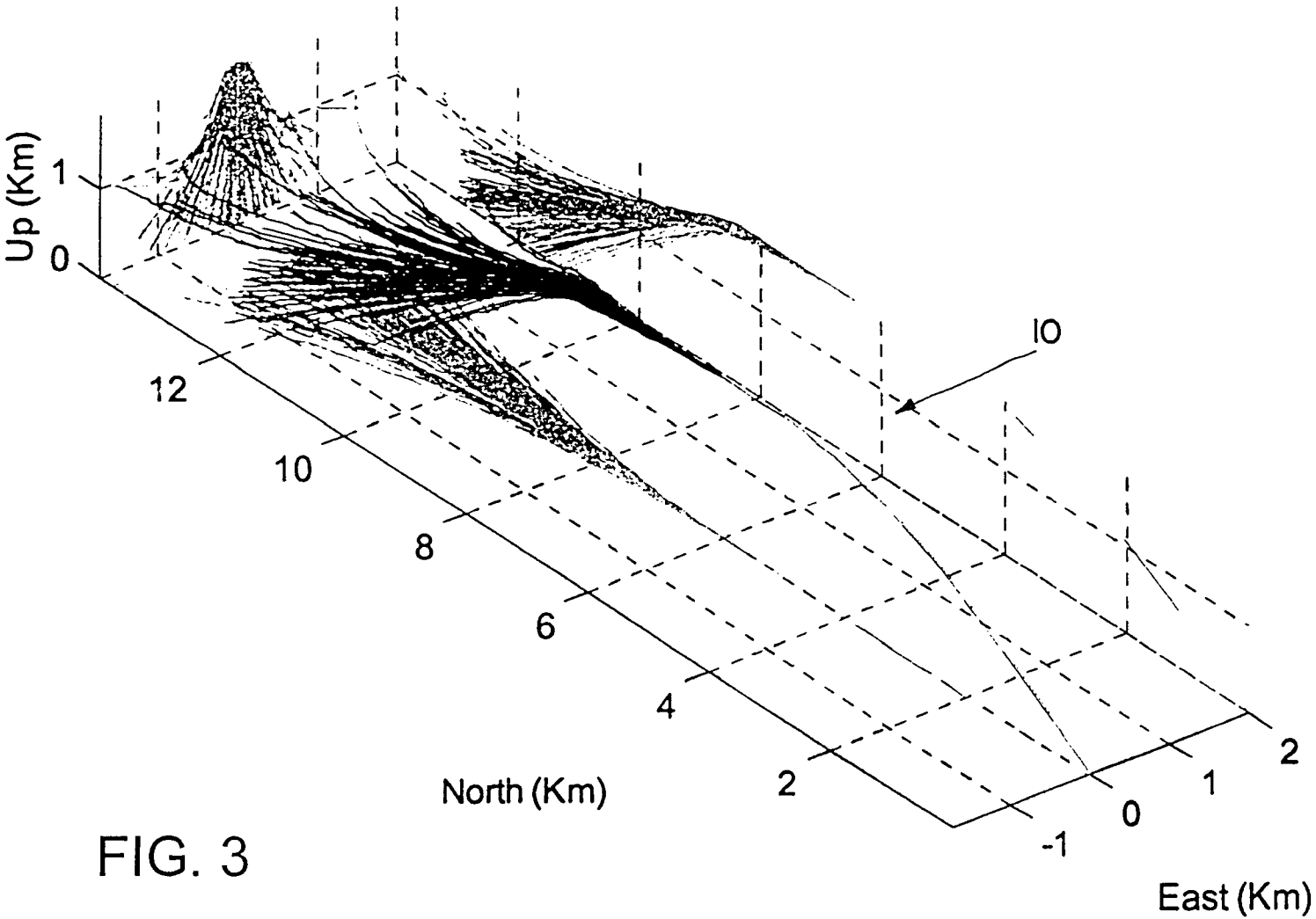
FIG. 3 is a representation showing trajectory results of a projectile sent along the flight path of FIG. 1, without any rotation.

The IMU 60 may be a microelectromechanical system (MEMS) IMU. MEMS involves the integration of items such as mechanical elements, sensors, actuators, and electronics on a common silicon substrate, through microfabrication technology. MEMS IMUs have the desirable characteristic of maintaining performance characteristics such as accuracy specifications even through large accelerations, such as those encountered during launch of a missile or projectile. Low-cost MEMS IMU units are available having a level of accuracy (gyroscope bias) of approximately 600 degrees/hour. However this level of accuracy is not sufficient, on its own, to provide desirable accuracy in guiding the missile 20 along the flight path 10 (FIG. 1). FIG. 3 illustrates the spread of trajectories that might typically occur using an IMU having a gyroscope bias of 600 degrees/hour. As may be seen, there is a significant spread of trajectories that results. Since deviations in trajectory accumulate in proportion to the square of the time of flight, the deviations become much more significant for longer flight times (and longer flight distances). The spread of trajectories shown in FIG. 3 may be an unacceptable performance, and in any event it would be more desirable for the missile to be more accurate.

One solution would be to use a MEMS IMU that has better accuracy. Indeed accuracy of the missile would be greatly improved by using a MEMS IMU with greater accuracy, such as with a gyroscope bias of 50 degrees/hour. While this would meet accuracy requirements, use of such an IMU may be undesirable or not achievable as a practical matter for various reasons. First of these is the added expense involved in using an IMU with better accuracy. The expense of the IMU is especially significant in a one-time use situation, such as with a missile or other munition, in which the IMU is destroyed along with the rest of the device. In addition improvements in IMU performance may be difficult or even as a practical matter impossible to obtain (in a usable configuration) for the environment encountered by a missile or other munition. The missile or other munition may be fired from a gun or launch tube, or otherwise be subjected to high accelerations during or immediately after launch. It will be appreciated that subjecting IMUs to sudden impulses or large accelerations may have an adverse effect on their performance characteristics. MEMS IMUs may perform better to the extent that they can better maintain good performance characteristics even after withstanding the sudden impulses or large accelerations that may occur during launch of the missile or other munition. However achievement of the desired accuracy solely through hardware improvements in MEMS IMUs may be difficult because of technical limitations. Therefore the solution of a MEMS IMU with better accuracy may be unavailable as a practical matter, with regard to technical issues and/or cost issues.

The missile or other projectile 20 may be rolled during portions of the flight path 10, while still retaining its ability to navigate, in order improve the performance of the missile or other projectile 20 while using a lower-accuracy IMU 60. By rolling the projectile 20 gyroscope bias errors of the IMU 60 (and perhaps other errors as well) are evened out (balanced out) to at least some degree by the rolling process. Although the bias errors are still present, the rotation of the projectile 20 causes the errors to change the results in different directions at different times.

One difficulty raised by the rotation of the missile or other projectile 20 is that rotation will cause the missile to lose its roll reference, depriving it of a piece of information the accuracy of which is relied upon for navigating the missile 20. The roll reference may be accurately maintained by use of a roll reference sensor that is coupled to the IMU 60 (FIG. 2) in order to correct the roll reference maintained by the IMU 60. The roll reference sensor may be any of a magnetic field sensor (such as a magentometer), a sunlight sensor, a horizon sensor, or an electrostatic field sensor, capable of providing on-board determination of the orientation of the projectile 20, for the purpose of correcting the roll reference. The roll reference sensor may act as a check upon results from a roll sensor, such as a gyroscope, that is part of the IMU 60, allowing correction of the roll reference maintained by the IMU 60.

Figure 4:
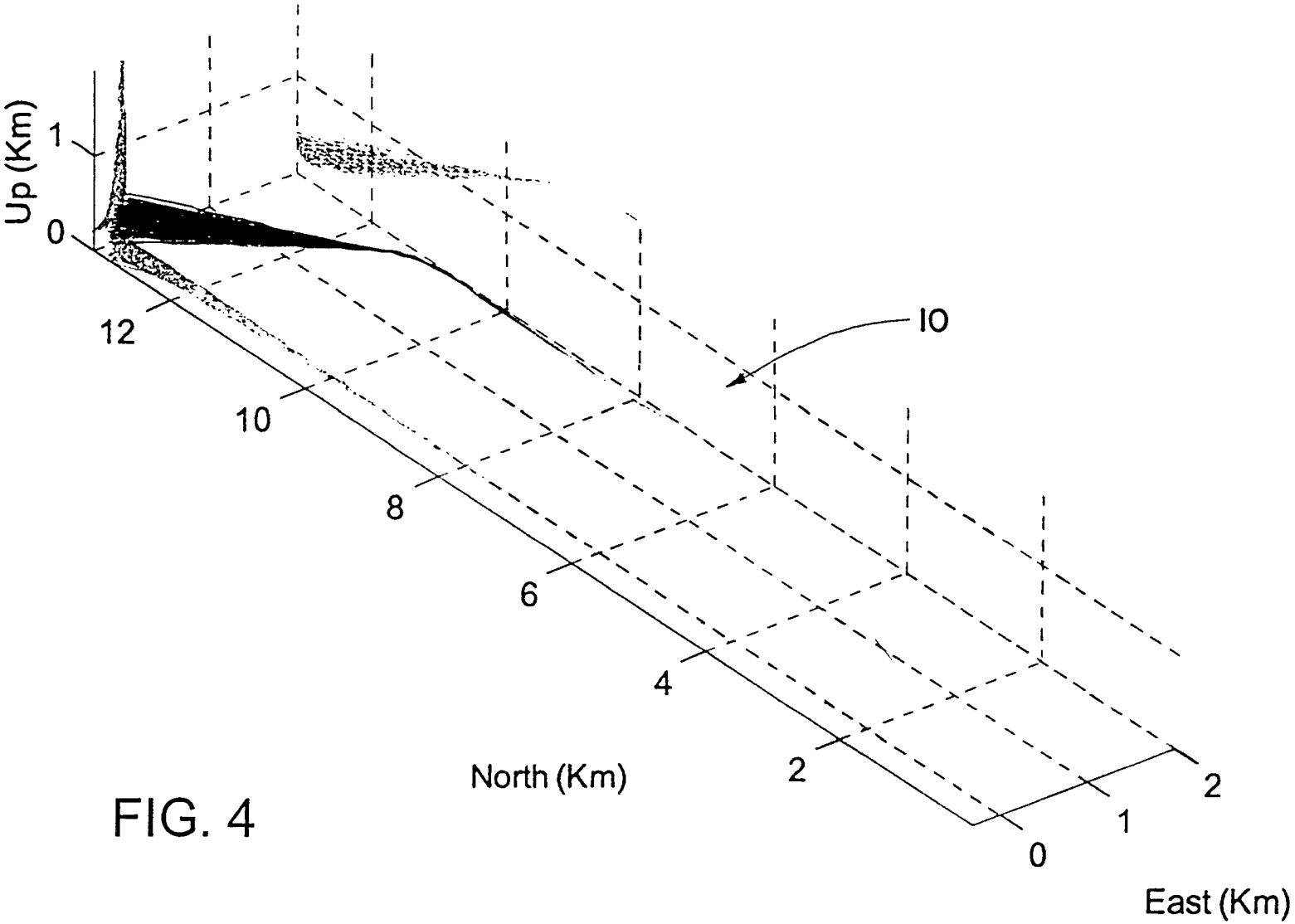
FIG. 4 is a representation showing trajectory results of a projectile sent along the flight path of FIG. 1, with rotation.

FIG. 4 shows the spread of trajectories from a missile or other projectile 20 following the flight plan 10, when the projectile 20 is rotated at a rate of 180 degrees/second. It will be appreciated that other roll rates (angular velocities) may be utilized, including roll rates of at least 180 degrees/second. It will be appreciated that the accuracy with the roll is much better than that of the non-rolling projectile (shown in FIG. 3).

Figure 5:
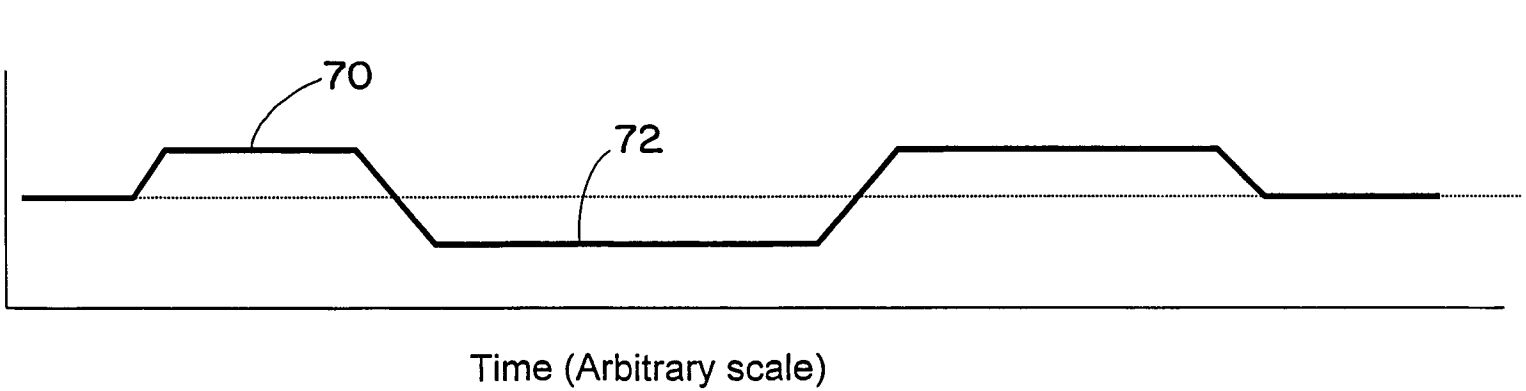
FIG. 5 is a representation of a function for varying roll rate over time, of arbitrary units, in accordance with an embodiment of the invention.
Figure 6:
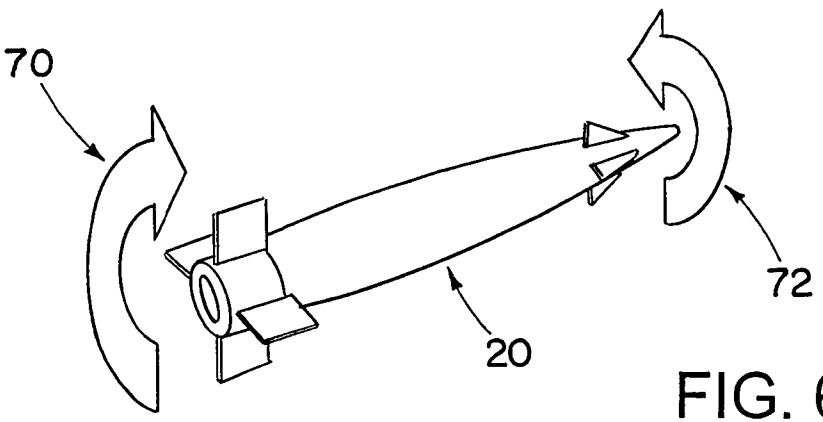
FIG. 6 is an oblique view of a projectile, illustrating the rocking rolling of the projectile in accordance with an embodiment of the invention.

Another way to aid in maintaining the roll reference is to shift directions of the rolling on a regular periodic basis. For example the roll rate may be varied over time as a ramped step function, as illustrated in FIG. 5, or otherwise varied in a repeated periodic function, such as a sinusoidal function. The roll in one direction is balanced out by roll in the other direction. The result is a rocking back and forth of the projectile 20, first rolling in one direction 70 and then rolling in the opposite direction 72, as illustrated in FIG. 6. The back-and-forth motion tends to balance out and thereby reduce bias and scale factor errors in the lateral axes.

The maximum roll rate may be at least 180 degrees/second. The variation of the roll rate with time may be such that multiple complete roll revolutions of the missile or projectile are made before the direction of revolution is reversed. For example about 6 full roll revolutions may be made before the roll direction is reversed. Thus switching of roll directions may occur on as a function of expected slope errors to prevent a large accumulated position error due to that error source.

Figure 7:
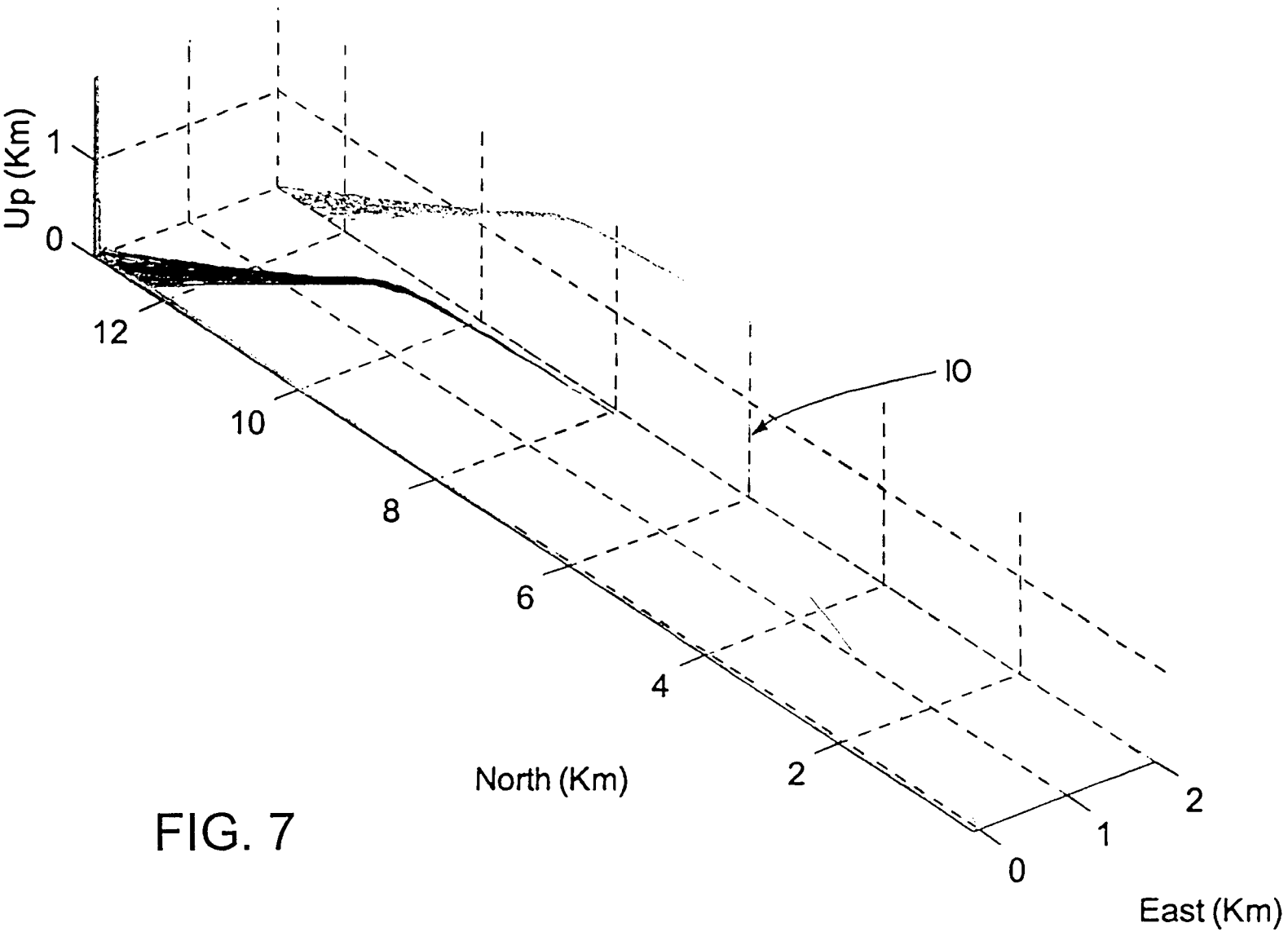
FIG. 7 is a representation showing trajectory results of a projectile sent along the flight path of FIG. 1, with rocking roll.

FIG. 7 shows the spread of trajectories for an example of applying use of the back-and-forth rocking roll motion to increase accuracy. The example shown in FIG. 7 involves combining the rocking roll with using a roll reference (orientation) sensor to correct the roll reference, although it will be appreciated that the alternating direction of the rolling may be done without correction of the roll reference. The trajectory spread shown in FIG. 7 is narrower than those shown in FIGS. 3 and 4, demonstrating that the rocking roll of the projectile 20 produces improved accuracy.

It will be appreciated that the periodic changes in roll direction of the missile 20 may be done as any of a variety of functions other than sinusoidal functions. The rolling of the projectile 20 may be accomplished by any of a variety of means, such as by firing of rockets, use of control surfaces to provide an appropriate moment on the projectile, or by use of vectored thrust from the thrust system 50 (FIG. 2) of the projectile 20.

Figure 8:
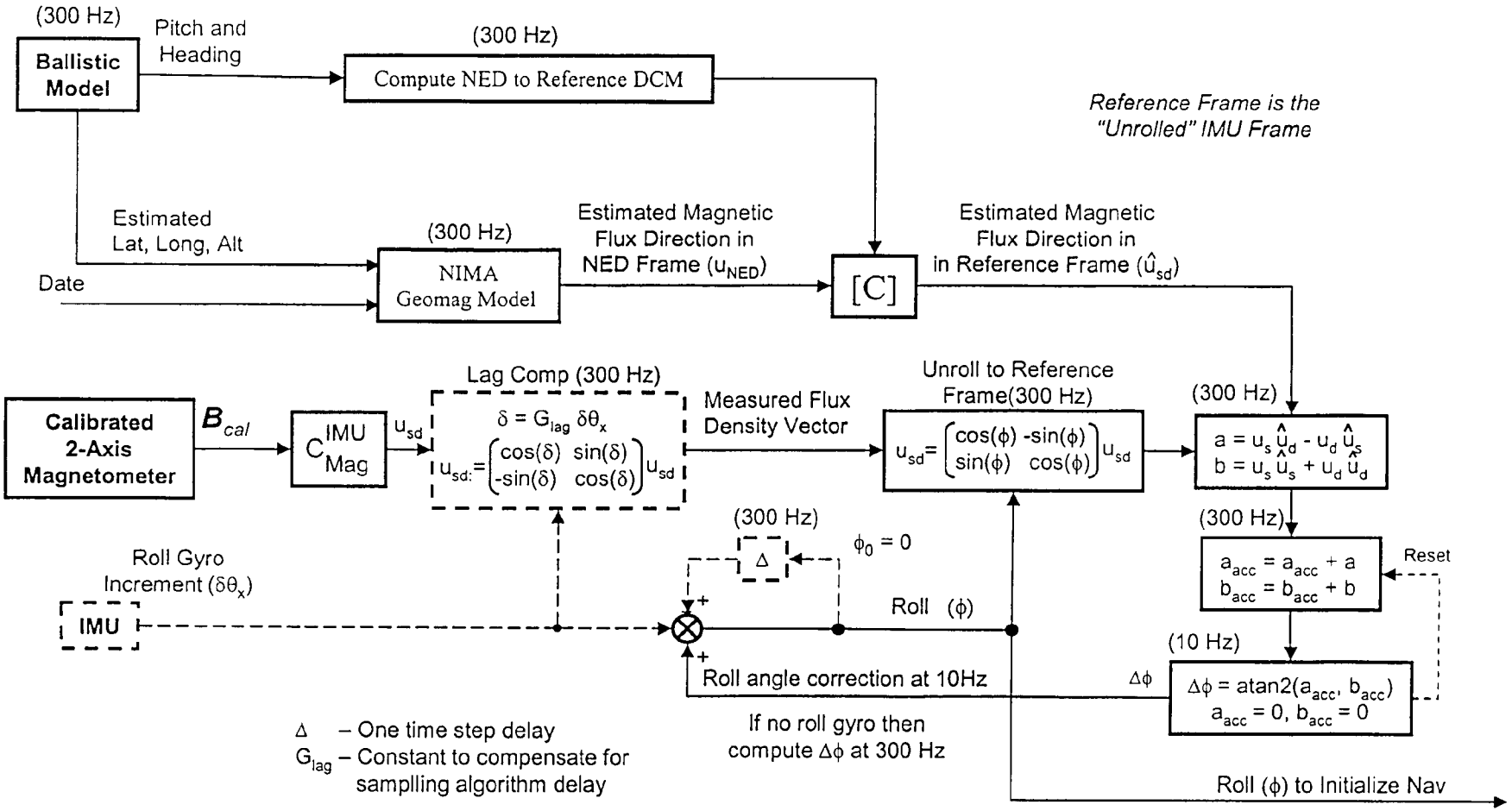
FIG. 8 is a diagram of roll reference correction, in accordance with an embodiment of the invention.
Figure 9:
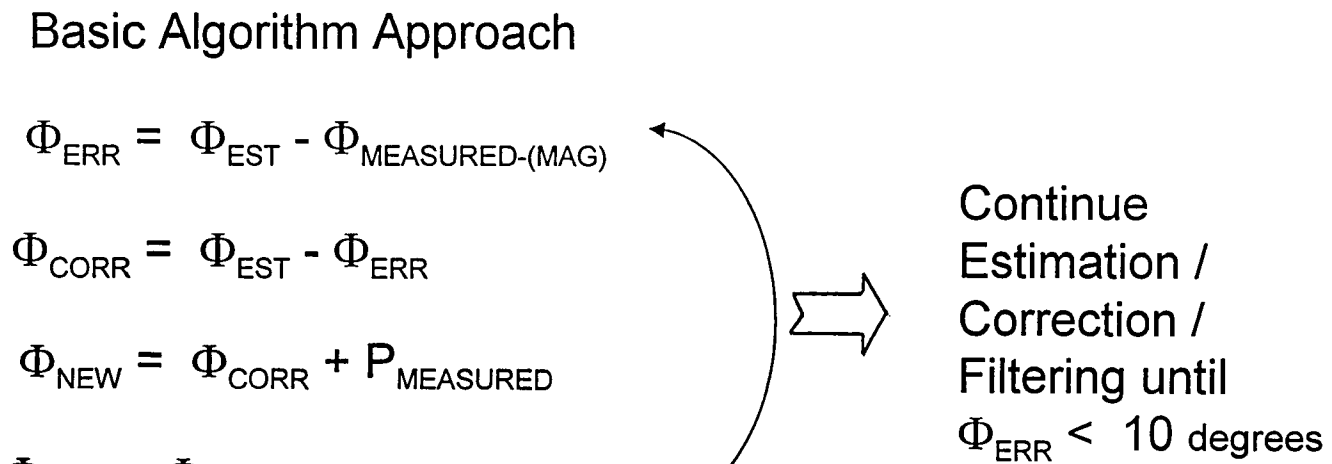
FIG. 9 is a diagram illustrating the basic approach utilized in the algorithm of FIG. 8.

FIG. 8 shows an algorithm used in correcting the roll reference of the missile 20, using input from a magnetometer that functions as an orientation sensor. The algorithm differs from those in prior systems since the present system uses the NIMA model to determine the expected magnetometer output in the navigation coordinate system. The magnetometer is read and transformed into the navigation frame and the two outputs (expected and measured) are merged and by use of a Kalman filter. The estimated roll attitude is adjusted until the error residual is minimal. This basic approach is illustrated in FIG. 9.

Rolling the projectile 20, either at a constant roll rate or by periodically changing the direction of the rolling, while also maintaining the roll reference of the IMU 60, provides increased accuracy for the missile 20. The rolling and referencing operations described herein provided marked improvement in accuracy. The rolling with referencing has been found to reduce dispersion by a factor of at least 10, to reduce angular attitude errors by a factor of at least 20, to reduce lateral velocity errors by a factor of at least 5, and to reduce lateral position errors by a factor of at least 5 to 10.The rocking rolling (with referencing) has been found to reduce dispersion by a factor of at least 10, to reduce angular attitude errors by a factor of at least 20, to reduce lateral velocity errors by a factor of at least 10, and to reduce lateral position errors by a factor of at least 5 to 10.The result is that accuracy of the missile 20 may be comparable to that that would be achieved by use of a much more accurate IMU. For example, with the disclosed rocking rolling, a MEMS IMU having an accelerometer bias of 50 mg and gyroscope bias of 600 degrees/hour may perform as well as a MEMS IMU having a bias of 50 degrees/hour. This allows requirements for lateral dispersion to be met with present MEMS IMUs, even though no MEMS IMUs of sufficient quality are available. Thus a factor of 10 improvement in accuracy may be obtained in hardened MEMS IMUs that are capable of being gun launched.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A method of flight control of a projectile, the method comprising:

providing the projectile with a microelectromechanical system (MEMS) inertial measurement unit (IMU); and reducing trajectory errors by rolling the projectile while maintaining a roll reference in the MEMS IMU, thereby ameliorating the effect of inaccuracies in the MEMS IMU by canceling out at least some of the effect of inaccuracies of the MEMS IMU.

2. The method of claim 1, wherein the keeping the roll reference includes using an orientation sensor of the projectile to correct the roll reference.

3. The method of claim 2, wherein the sensor includes a magnetometer.

4. The method of claim 1, wherein the rolling includes rolling at a substantially constant roll rate over time.

5. The method of claim 1, wherein the rolling includes alternating roll directions as part of rolling the projectile.

6. The method of claim 5, wherein the alternating roll directions includes varying roll rate as a repeating periodic function over time.

7. The method of claim 6, wherein the repeating periodic function is a ramped step function.

8. The method of claim 1, wherein the rolling includes rolling at a rate of at least 180 degrees/second.

9. The method of claim 1, wherein the reducing trajectory errors includes improving accuracy of the MEMS IMU by at least a factor of ten.

10. A method of flight control of a projectile, the method comprising:

during flight of the projectile, rolling the projectile periodically using a control system of the projectile, first rolling the projectile in a first direction, then rolling the projectile in a second direction that is opposite the first direction;

wherein the rolling includes varying roll rate as a repeating periodic function over time, wherein the function alternates between the first direction and the second direction.

11. The method of claim 10, wherein the repeating periodic function is a ramped step function.

12. The method of claim 10, further comprising keeping a roll reference of a microelectromechanical system (MEMS) inertial measurement unit (IMU) during the rolling.

13. The method of claim 12, wherein the keeping the roll reference includes using an orientation sensor of the projectile to correct the roll reference.

14. The method of claim 13, wherein the sensor includes a magnetometer.

15. The method of claim 10, wherein the rolling includes rolling at a maximum roll rate of at least 180 degrees/second.

16. A method of operating a projectile, the method comprising:

providing the projectile with a microelectromechanical system (MEMS) inertial measurement unit (IMU) that maintains performance characteristics through accelerations associated with launching the projectile from a gun; and maneuvering the projectile during flight to reduce the effect of inaccuracies of the MEMS IMU, wherein the maneuvering ameliorates the effect of inaccuracies by canceling out at least some of the effect of inaccuracies.

17. The method of claim 16, wherein the maneuvering includes rolling the projectile.

18. The method of claim 17, wherein the rolling includes alternately rolling the projectile periodically in opposite directions, wherein the alternating rolling includes varying roll rate as a repeating periodic function over time.

* * * * *